US006715623B2

(12) United States Patent
Broerman

(10) Patent No.: US 6,715,623 B2
(45) Date of Patent: Apr. 6, 2004

(54) COLLAPSIBLE DISPLAY SHELVING

(75) Inventor: John Quintin Broerman, Maineville, OH (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 10/082,891

(22) Filed: Feb. 26, 2002

(65) Prior Publication Data

US 2003/0160015 A1 Aug. 28, 2003

(51) Int. Cl.[7] ..... A47F 5/00
(52) U.S. Cl. ..... 211/149; 248/174
(58) Field of Search ..... 211/149; 248/174

(56) References Cited

U.S. PATENT DOCUMENTS

| | | | | |
|---|---|---|---|---|
| 901,858 A | | 10/1908 | Williams | 229/117.06 |
| 957,218 A | | 5/1910 | Klefeker | 229/117.07 |
| 2,088,741 A | | 8/1937 | Hanson | 211/41 |
| 2,249,234 A | | 7/1941 | Srodulski | 312/42 |
| 2,502,693 A | | 4/1950 | Alton | 211/133 |
| 2,642,330 A | | 6/1953 | Armour | 312/257 |
| 2,918,178 A | * | 12/1959 | Leone | 211/195 |
| 3,045,835 A | | 7/1962 | Hawthorne et al. | 211/149 |
| 3,093,247 A | | 6/1963 | Erickson | 211/149 |
| 3,144,134 A | | 8/1964 | Frommgen | 211/126 |
| 3,307,767 A | | 3/1967 | Humphrey et al. | 229/27 |
| 3,494,479 A | | 2/1970 | Martin | 211/126 |
| 3,863,575 A | | 2/1975 | Kuns et al. | 108/111 |
| 4,122,782 A | | 10/1978 | Coombs | 108/111 |
| 4,202,278 A | | 5/1980 | Wadenhed | 108/182 |
| 4,271,766 A | | 6/1981 | Schmiedeler | 108/111 |
| 4,311,100 A | | 1/1982 | Gardner et al. | 108/111 |
| 4,415,090 A | | 11/1983 | Bustos | 211/49 |
| 4,519,319 A | | 5/1985 | Howlett | 108/111 |
| 4,552,271 A | | 11/1985 | Kranz | 211/41 |
| 4,582,003 A | | 4/1986 | Valero | 108/111 |

(List continued on next page.)

FOREIGN PATENT DOCUMENTS

| | | | |
|---|---|---|---|
| DE | 33 41 335 A1 | 5/1985 | A47B/47/04 |
| EP | 0 220 788 A1 | 5/1987 | B65D/5/52 |
| FR | 1 350 885 | 12/1963 | |
| GB | 530986 | 12/1940 | |

OTHER PUBLICATIONS

Reference#1: Picture of articulated display shelving, at least as early as Feb. 25, 2001.
Reference#2: Boxed cards display set–up instructions, at least as early as Feb. 25, 2001.

*Primary Examiner*—Daniel P. Stodola
*Assistant Examiner*—Erica B. Harris
(74) *Attorney, Agent, or Firm*—Greenberg Traurig, P.C.

(57) ABSTRACT

A collapsible shelving display is preferably fabricated, at least in part, from corrugated paperboard. Side wall assemblies are hingedly connected to a back wall to form a stand. The stand includes foldable shelf support members that are formed from portions cut from the back wall and partially cut from inner panels of the side wall assemblies. Shelves are pivotably attached to the back wall, and swingable between positions substantially parallel to the back wall to positions oblique or perpendicular to the back wall.

14 Claims, 7 Drawing Sheets

U.S. PATENT DOCUMENTS

| | | | | |
|---|---|---|---|---|
| 4,723,664 | A | 2/1988 | Smith | 211/149 |
| 4,740,010 | A | 4/1988 | Moskovitz | 280/641 |
| 4,911,311 | A | 3/1990 | Nagai | 211/126 |
| 4,942,830 | A | 7/1990 | Macaluso et al. | 108/111 |
| 4,949,851 | A | 8/1990 | Shaffer | 211/149 |
| 5,213,220 | A | 5/1993 | McBride | 211/132 |
| 5,230,423 | A | 7/1993 | Gellatly | 206/45.14 |
| 5,253,769 | A | 10/1993 | Vlastakis | 211/126 |
| 5,315,936 | A | 5/1994 | Smith | 108/165 |
| 5,316,156 | A | 5/1994 | Land et al. | 211/149 |
| 5,322,172 | A | 6/1994 | Maglione | 211/132 |
| 5,392,902 | A | 2/1995 | Vlastakis | 206/45 |
| 5,458,411 | A | 10/1995 | Moss | 312/259 |
| 5,522,574 | A | 6/1996 | Maglione | 248/174 |
| 5,669,683 | A | 9/1997 | Moss et al. | 312/259 |
| 5,692,714 | A | 12/1997 | Morrison | 248/174 |
| 5,706,959 | A | 1/1998 | Smith | 211/132 |
| 5,826,732 | A | 10/1998 | Ragsdale | 211/149 |
| 5,899,345 | A | 5/1999 | Fuller et al. | 211/132.1 |
| 5,984,120 | A | 11/1999 | Johnske | 211/132.1 |
| 6,068,140 | A | 5/2000 | Mangrum et al. | 211/132.1 |
| 6,098,820 | A | 8/2000 | Smith | 211/132.1 |
| 6,126,254 | A | 10/2000 | Maglione | 312/259 |
| 6,145,794 | A | 11/2000 | Smith | 248/121 |
| 6,612,669 | B2 * | 9/2003 | Grueneberg | 211/149 |

* cited by examiner

COLLAPSIBLE DISPLAY SHELVING

BACKGROUND OF THE INVENTION

1. Field of the Invention

The present invention is directed to point of purchase display shelving structures, in particular point of purchase display shelving structures for small products, that may be packaged in individual cartons or boxes, and stacked in arrays. The present invention is directed in particular to such point of purchase display shelving structures that are fabricated from paper, paperboard, and corrugated paper and corrugated paperboard materials, and which are configured to be transported to their point of use in a collapsed, but otherwise fully assembled configuration.

2. Prior Art

Point of purchase display shelving structures for small size goods are well known. Such shelving structures are often fabricated from metal or plastic, and are fabricated to be quickly set up and knocked down, in order to accommodate the needs of the particular business establishment, as well as the changing promotional events that prompt the use of the point of purchase display shelving.

However, such metal and/or plastic displays are typically very generic in shape, little more than open-topped or open-front bins in which the goods are piled or stacked. Furthermore, such metal and/or plastic displays can be relatively heavy and/or bulky, even in their broken down form, and can be relatively expensive to fabricate, especially since they are not always intended for multiple uses, and are discarded after only one use.

Point of purchase display shelving structures for small articles, that have been fabricated from paper, paperboard, and corrugated paper and corrugated paperboard are known. Such point-of-purchase display shelving structures have the advantage of typically being lighter in weight than comparable metal or plastic structures. In addition, such display shelving structures are typically less expensive to manufacture and ship. Furthermore, such display shelving structures are often more amenable to recycling than metal or plastic structures, once their function as a display shelving structure has been completed.

Point of purchase display shelving structures, fabricated from paper, paperboard and/or corrugated paperboard, are also known which are manufactured and shipped to the ultimate consumer/point of use in a collapsed, but otherwise fully assembled form, in order to permit the shelving structure to be shipped in a minimum amount of volume, for reduced shipping costs. However, such prior art collapsible display shelving structures often suffer from a reduced structural strength, in comparison to non-collapsible paper, paperboard and/or corrugated paperboard material, or metal or plastic structures.

As such, it would be desirable to provide a collapsible display shelving structure, fabricated from paper, paperboard and/or corrugated paperboard, that is provided with enhanced structural strength and robustness, while retaining an economical configuration that is also relatively easy to raise from its collapsed construction.

These and other desirable characteristics of the invention will become apparent in light of the present specification, including claims, and drawings.

SUMMARY OF THE INVENTION

The present invention is directed to a collapsible shelving display fabricated at least in part from at least one of paper, paperboard, or corrugated paperboard material.

The collapsible shelving display comprises a stand, including a substantially planar back wall, having two opposed side edge regions; two side wall assemblies foldably connected to respective ones of the two opposed side edge regions of the back wall, each of the two side wall assemblies being movable between a position substantially perpendicular to the back wall and foldably attached thereto, and a position substantially parallel and juxtaposed to the back wall; and at least one foldable shelf support member operably connected to each of the inner surfaces of the two side wall assemblies, the at least one foldable shelf support member being articulable, between a position extending substantially straight across from one side wall assembly to the other and spaced from the back wall when both side wall assemblies are substantially perpendicular to the back wall, and a collapsed position wherein portions of the at least one shelf support member are folded over upon other portions of the shelf support member and substantially juxtaposed against the back wall, when both side wall assemblies are substantially parallel and juxtaposed to the back wall; and at least one shelf positionable over said shelf support member, for supporting an article.

Preferably, the at least one shelf comprises at least one shelf member pivotably attached to the back wall, and pivotable between a collapsed position substantially parallel and juxtaposed to the back wall and a supporting position not substantially parallel and juxtaposed to the back wall, such that a portion of the at least one shelf member rests atop a portion of the at least one foldable shelf member, when the at least one foldable shelf member is in the position extending substantially straight across from one side wall assembly to the other.

Preferably, each side wall assembly comprises an inner side panel foldably connected to one of the side edge regions of the back wall; an outer side panel connected to the inner side panel; and a side reinforcement panel, connected to the outer side panel and disposed between the inner and outer side panels.

In a preferred embodiment of the invention, a leading edge of each side wall assembly is inclined.

Preferably, the at least one foldable shelf support member comprises a central panel, having two opposite ends; end panels foldably connected to each end of the central panel, each end panel further being foldably connected to a respective one of the side wall assemblies, wherein at least the central panel is formed and cut from a portion of the substantially planar back wall.

The at least one foldable shelf support member preferably further comprises two support panels, formed and cut from portions of rearward portions of the inside surfaces of the respective side wall assemblies, and folded forward to overlie and be affixed to other adjacent portions of the inside surfaces of the respective side panel assemblies. Each of the two support panels is preferably connected to respective ones of the end panels of the at least one foldable shelf support member.

In a preferred embodiment, at least the central panel of the at least one shelf support member preferably further comprises a lower portion which is substantially parallel to the back wall, and an upper portion which is foldable between a position substantially parallel to the back wall, and a supporting position at an intersecting angle with respect to the back wall. Preferably, the stand is fabricated from corrugated paperboard material, and the corrugations are oriented such that the corrugations extend horizontally in the lower portions of the central panel of the at least one shelf support member.

In an alternative preferred embodiment at least one of the end panels of the at least one shelf support member comprises a lower portion which is substantially parallel to the back wall, and an upper portion which is foldable between a position substantially parallel to the back wall, and a supporting position at an intersecting angle with respect to the back wall. Preferably, the stand is fabricated from corrugated paperboard material, and the corrugations are oriented such that the corrugations extend horizontally in the lower portion of the at least one end panel of the at least one shelf support member.

A preferred embodiment of the invention further includes a signage riser, extending upwardly from the back wall. Preferably, the stand is fabricated from a single blank of material.

The collapsible shelving display further comprises in an alternative embodiment, a cover panel connected to and emanating from an upper edge region of each outer side panel, for covering a gap between each respective outer side panel and its corresponding inner side panel.

The present invention also comprises in part, a collapsible shelving display fabricated at least in part from corrugated paperboard material, wherein the collapsible shelving display comprises a stand, including a substantially planar back wall, having two opposed side edge regions, two side wall assemblies foldably connected to respective ones of the two opposed side edge regions of the back wall, each of the two side wall assemblies being movable between a position substantially perpendicular to the back wall and foldably attached thereto, and a position substantially parallel and juxtaposed to the back wall; and at least one foldable shelf support member operably connected to each of the inner surfaces of the two side wall assemblies, the at least one foldable shelf support member being articulable, between a position extending substantially straight across from one side wall assembly to the other and spaced from the back wall when both side wall assemblies are substantially perpendicular to the back wall, and a collapsed position wherein portions of the at least one shelf support member are folded over upon other portions of the shelf support member and substantially juxtaposed against the back wall, when both side wall assemblies are substantially parallel and juxtaposed to the back wall; wherein the corrugations of the corrugated paperboard material, in the planar back wall, the two side wall assemblies and the at least one foldable shelf support member, extend horizontally.

DETAILED DESCRIPTION OF THE DRAWINGS

Figure 1:
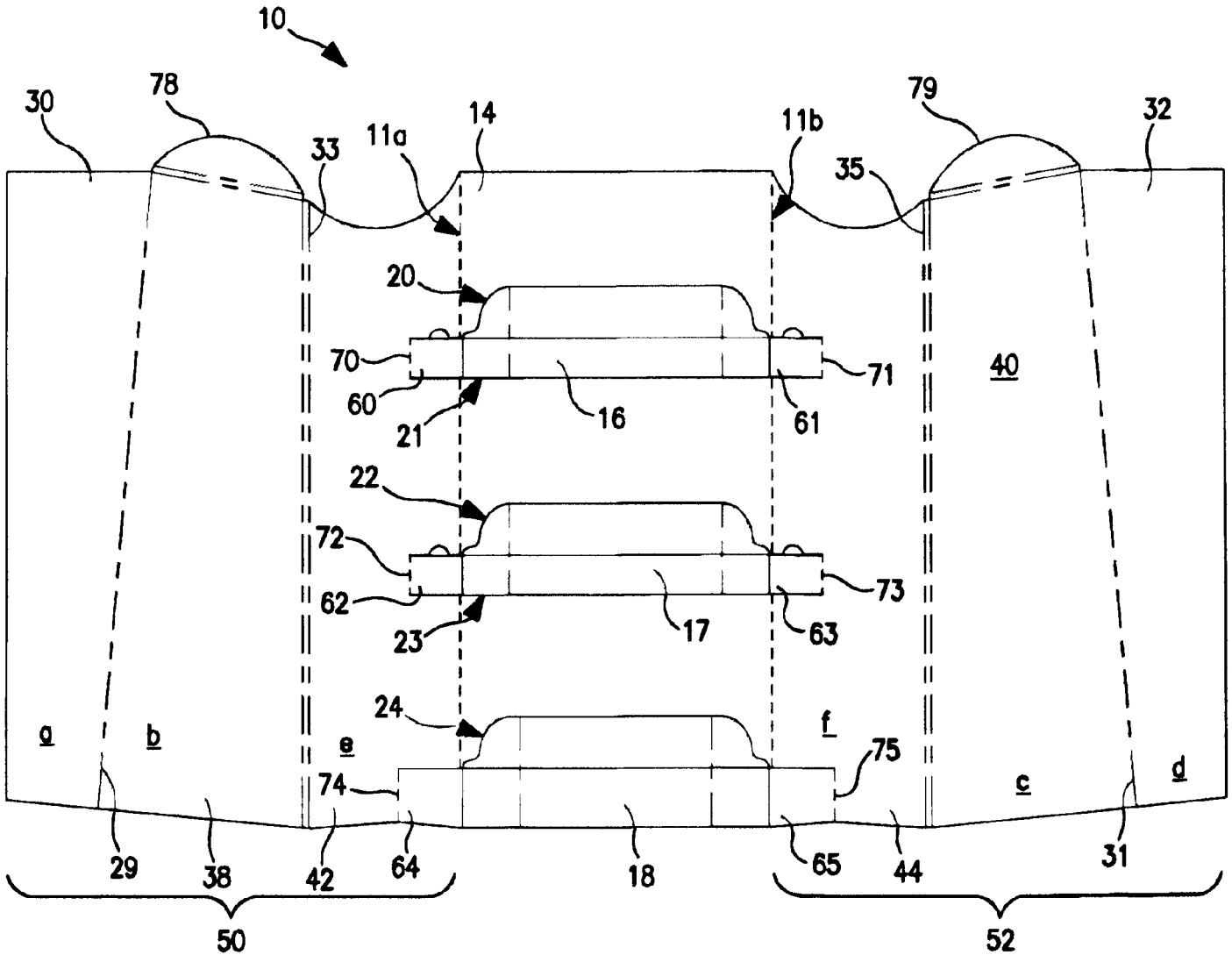
FIG. 1 is a plan view of the blank for the stand for the collapsible display shelving, according to a preferred embodiment of the invention.
Figure 2:
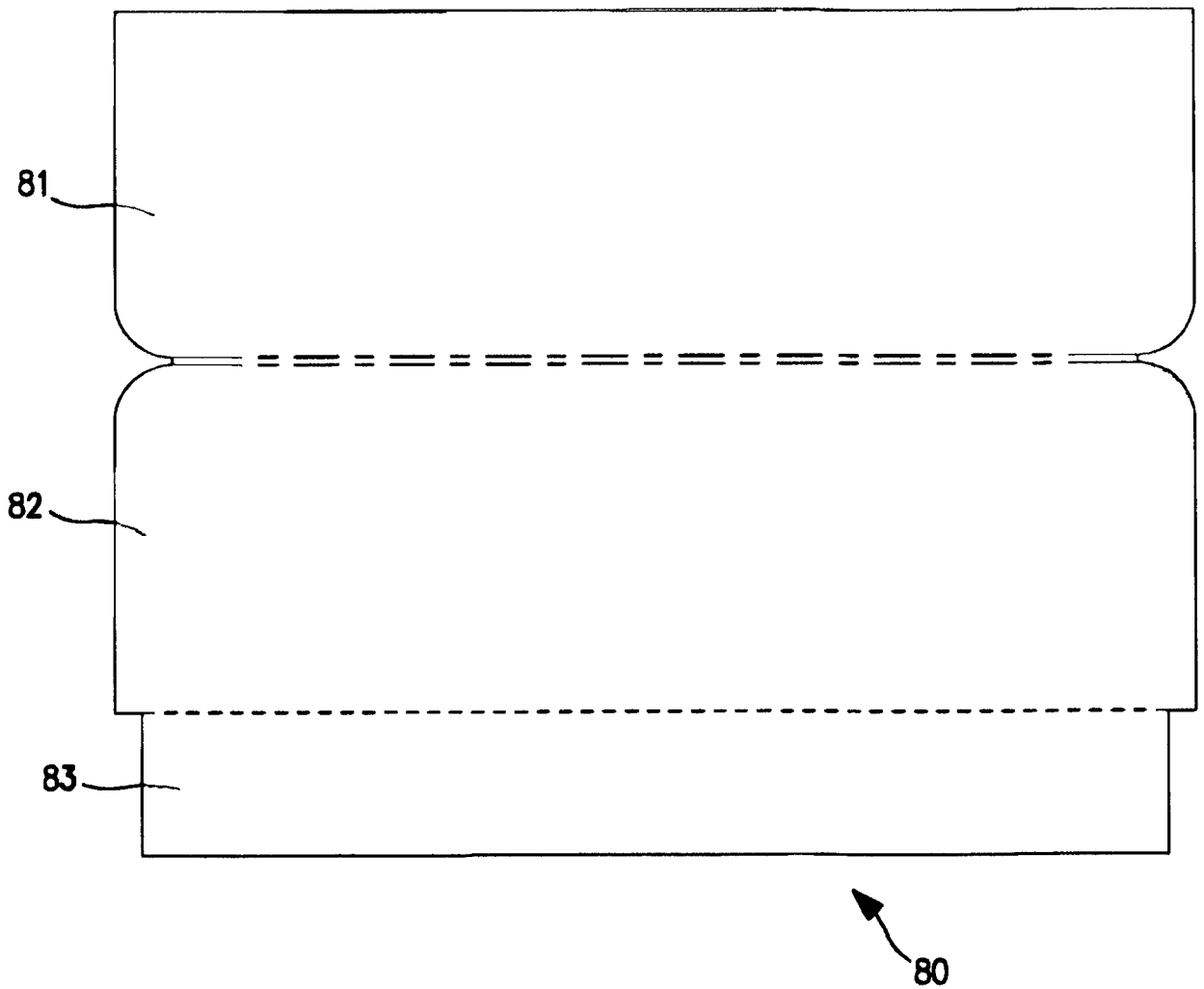
FIG. 2 is a plan view of the blank for the riser for the stand for the collapsible display shelving, according to the embodiment of FIG. 1.
Figure 3:
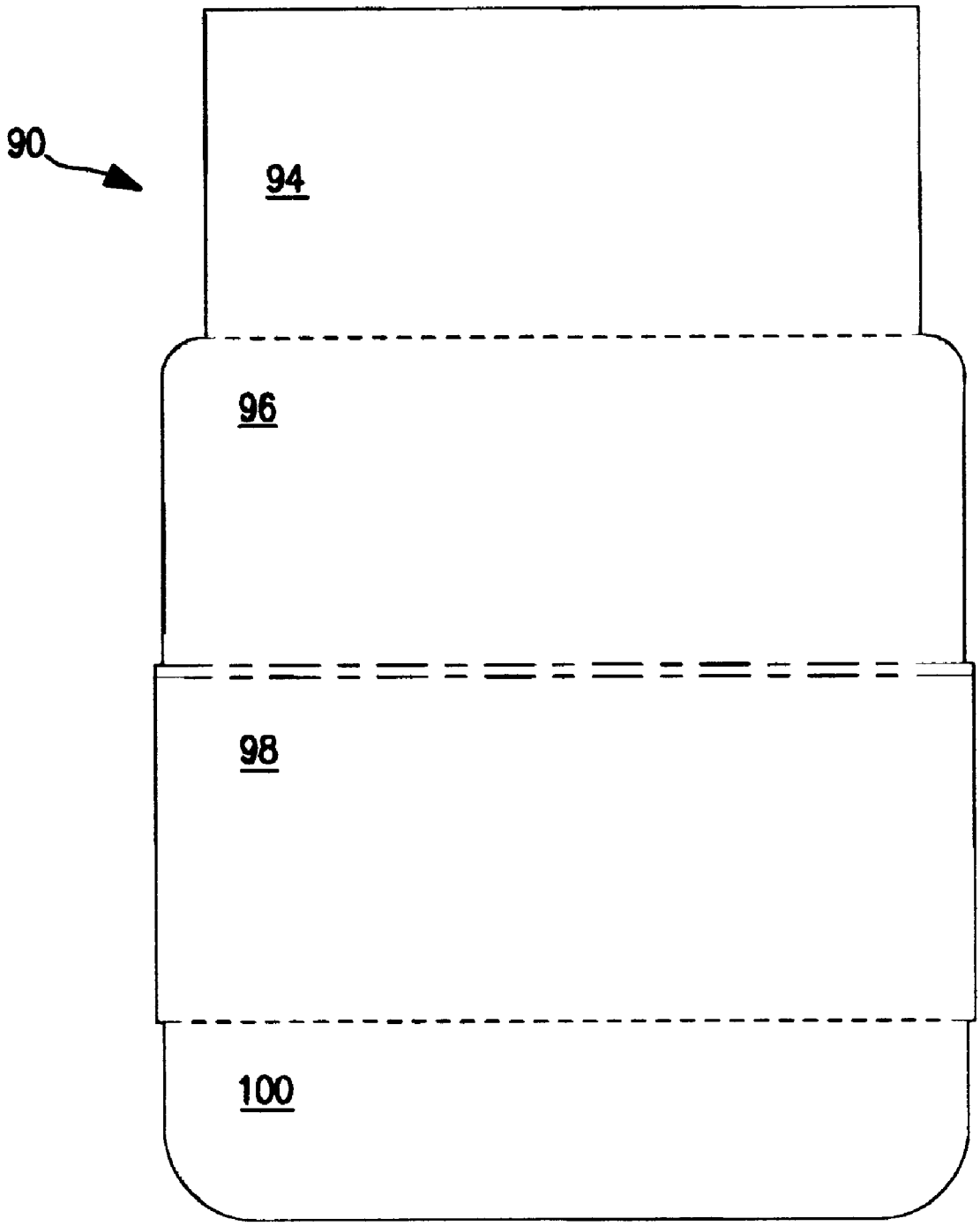
FIG. 3 is a plan view of the blank for a shelf for the collapsible display shelving, according to the embodiment of FIGS. 1 and 2.
Figure 4:
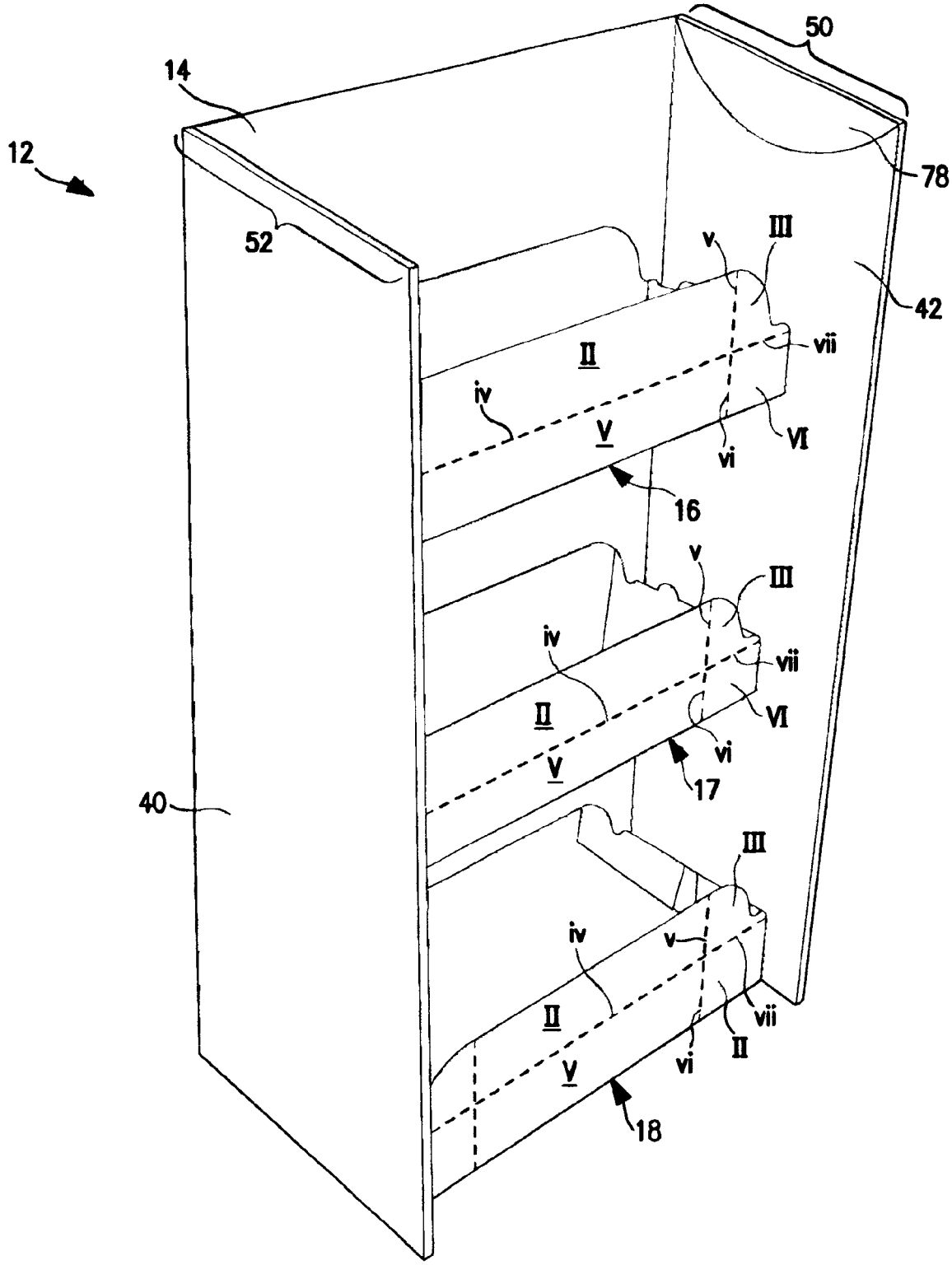
FIG. 4 is a perspective view of the assembled and articulated stand for the collapsible display shelving according to the embodiment of FIGS. 1–3, without the shelves or riser.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

One version of the collapsible display shelving, according to a preferred embodiment of the invention, is shown in FIGS. 1–7.

FIG. 1 is a plan view of blank 10 for the stand 12 for the collapsible display shelving, according to a preferred embodiment of the invention. In a preferred embodiment of the invention, blank 10 is fabricated from corrugated paperboard material, and a preferred direction for the corrugations is indicated by arrow A in FIG. 1. In particular, blank 10 is seen from its back side, in FIG. 1. Blank 10 includes back wall 14, from which the shelf support members 16, 17 and 18 are formed via through cuts 20, 21, 22, 23 and 24. The several lines shown within the boundaries of each shelf support member 16–18, defined by cuts 20–24 and fold lines 70–75, represent scores or other lines of weakness, which permit shelf support members 16–18 to be folded upon themselves, as described herein in further detail. While blank 10 is configured for providing shelf supports for three shelves, a greater or lesser number of shelves may be provided, if desired, by altering the dimensions of blank 10, to provide for a greater or lesser number of shelf supports.

Blank 10 also includes side reinforcement panels 30, 32, emanating from rear edges of outer side panels 38–40 respectively. Outer side panels 38, 40 emanate from the rear edges of inner side panels 42, 44, respectively. Inner side panels 42, 44 emanate from the opposite side edge regions 11*a*, 11*b* of back wall 14.

To form stand 12, side reinforcement panels 30, 32 are folded along fold lines 29, 31, and attached (e.g., by any suitable adhesive) to outer side panels 38, 40, so that surface a is against surface b, and surface c is against surface d.

Outer side panels 38, 40 are folded about double fold lines 33, 35, so that side reinforcement panels 30, 32 are between outer side panels 38, 40, and inner side panels 42, 44, respectively, and adhered to surfaces e and f, respectively, to form side panel assemblies 50, 52.

Side panel assemblies 50, 52 are then folded perpendicular to back wall 14 (away from the observer, as seen in FIG. 1). To create the self-deploying connection between the shelf supports 16–18 and side panel assemblies 50, 52, connection panels 60–65 are pushed forwardly (away from the observer of FIG. 1) and folded around fold lines 70–75, the "far" surfaces of connection panels 60–65 are juxtaposed against and affixed to (e.g., via adhesive) the "far" surfaces of inner side panels 42, 44. Sector panels 78, 79 are folded down and affixed to corresponding surfaces of outer side panels 38, 40. The function of sector panels 78 and 79 is to cover the gap between outer side panels 38, 40 and inner side panels 42, 44, and to provide a smooth top surface to each side panel assembly 50, 52, so that the corrugation ends or sides at the edges of panels 42, 44, 30 and 32 are not exposed.

Blank 10 also includes side reinforcement panels 30, 32, emanating from rear edges of outer side panels 38–40 respectively. Outer side panels 38, 40 emanate from the rear edges of inner side panels 42, 44, respectively. Inner side panels 42, 44 emanate from the opposite side edge regions 11*a*, 11*b* of back wall 14.

Figure 5:
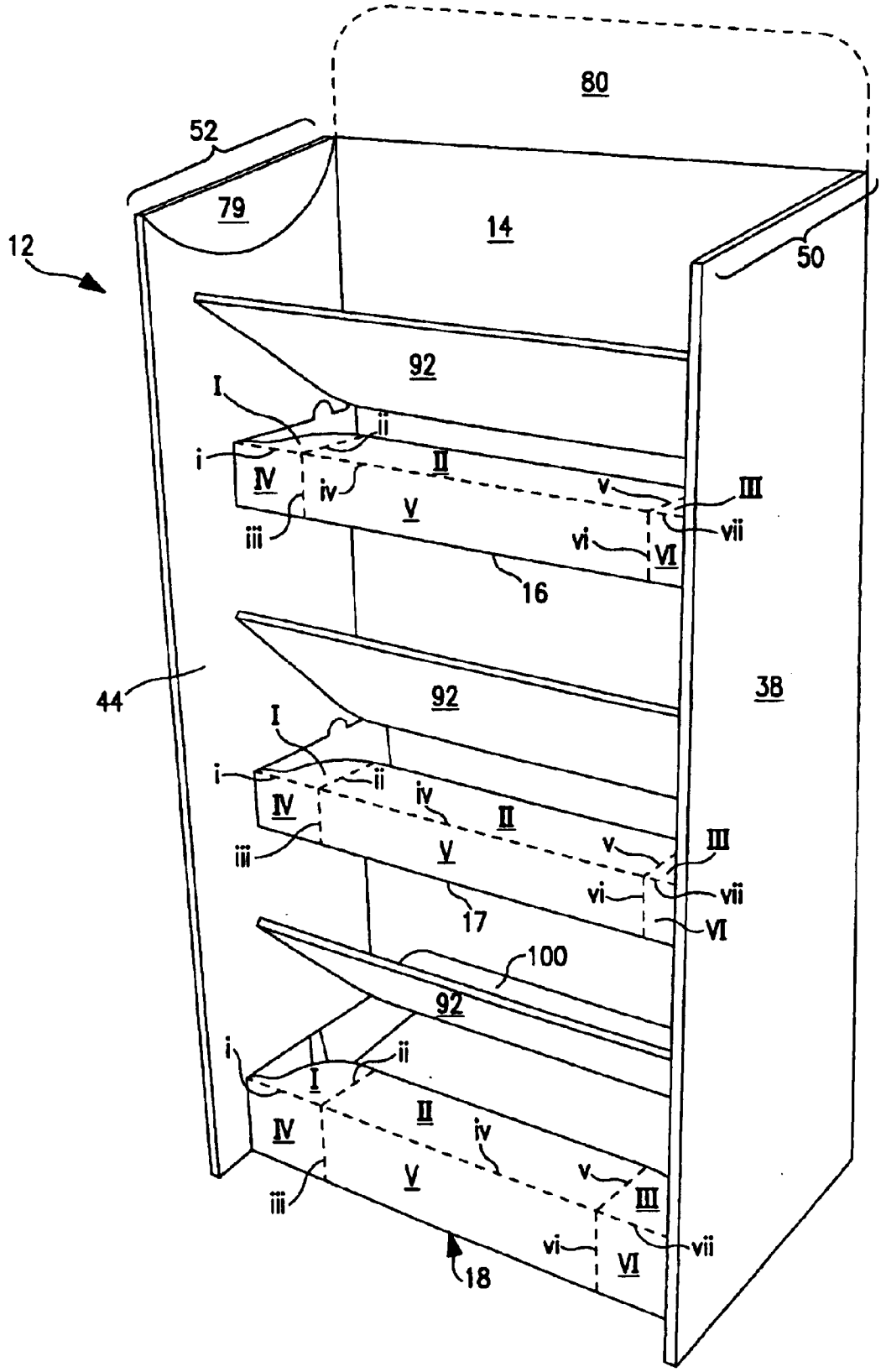
FIG. 5 is a perspective view of the collapsible display shelving according to the embodiment of FIGS. 1–4, without the riser, with the shelves attached to the fully assembled and articulated stand, but with the shelves not fully positioned down upon the shelf support portions.

FIG. 5 is a perspective view of the collapsible display shelving according to the embodiment of FIGS. 1–4, with the shelves 92 attached to the fully assembled and articulated stand 12, but with the shelves 92 not fully positioned down upon the shelf support members 16–18. In order to enable shelves 92 to be fully deployed, panels I–III of shelf support members 16–18 are folded about fold lines i, iv and vii, toward back wall 14, and substantially perpendicular to panels IV–VI. Depending upon the positioning of attachment flaps 100 relative to back wall 14, when shelves 92 are folded down, shelves 92 may be horizontal, or inclined downwardly or upwardly, front-to-back. Once shelves 92 have been affixed to stand 12, the collapsible display shelving 102 is fully assembled.

Figure 6:
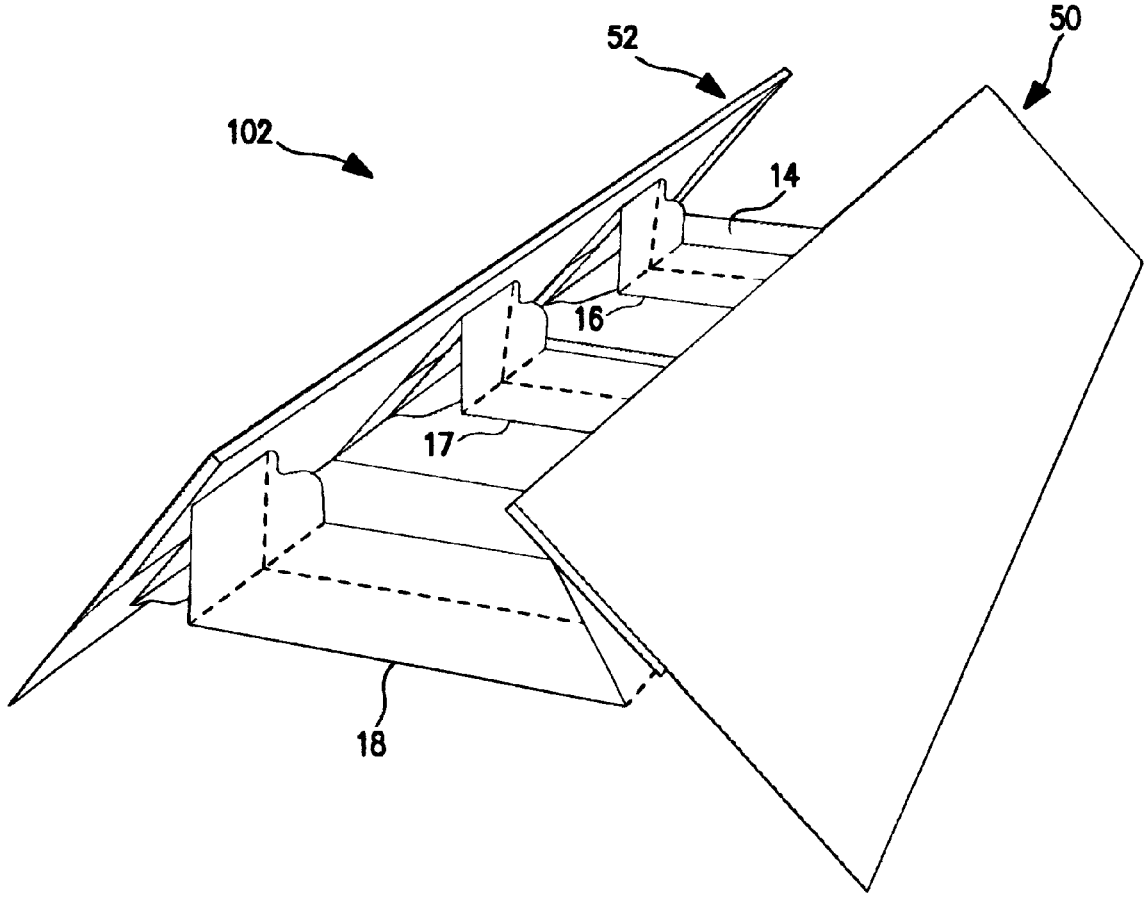
FIG. 6 is a bottom perspective view of the collapsible display shelving according to the embodiment of FIGS. 1–5, without the riser, with the shelves folded up against the inside surface of the back wall, the shelf supports collapsed, and the sidewalls partially folded in toward one another and toward the inside surface of the back wall, the shelves having been omitted to facilitate illustration of the shelf support structures.
Figure 7:
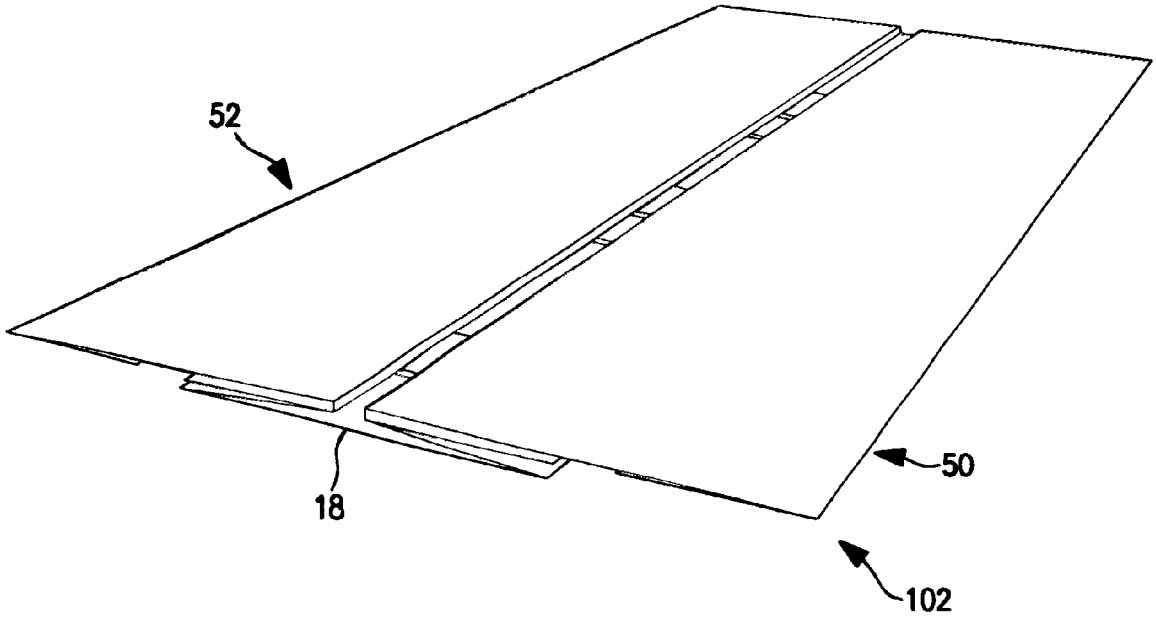
FIG. 7 is a bottom perspective view of the collapsible display shelving according to the embodiment of FIGS. 1–6, without the riser, with the shelves folded up against the inside surface of the back wall, the shelf supports collapsed, and the sidewalls fully folded in toward one another and toward the inside surface of the back wall.

FIG. 6 is a bottom perspective view of the collapsible display shelving according to the embodiment of FIGS. 1–5, the shelves having been omitted to facilitate illustration of the flattened and inwardly folding shelf support structures. In a finished product according to a preferred embodiment of the invention, the shelves would be folded up against the inside surface of the back wall, the shelf supports collapsed, and the sidewalls partially folded in toward one another and toward the inside surface of the back wall. The process of collapsing collapsible display shelving 102 begins with shelves 92 being pushed upward, so that upper panels 98 are juxtaposed parallel to the inner surface of back wall 14. Shelf support panels I–III are folded upward, to be parallel again to their respective shelf support panels IV–VI. Shelf support members 16–18 are then folded about fold lines ii–iii and v–vi, respectively, as side wall assemblies 50, 52 are folded inwardly toward one another. Eventually, as shown in FIG. 7, the shelf supports 16–18 will be fully collapsed, and the side wall assemblies 50, 52 will be fully folded substantially coplanar with one another and substantially parallel to the inside surface of back wall 14.

In a preferred embodiment of the invention, when blank 10 is fabricated from corrugated paperboard material, the corrugations extend horizontally from side to side. Alternatively, the corrugations in blank 10 may be configured to run top to bottom in the completed display stand. The present invention is believed to be advantageous with respect to existing corrugated display stand designs, in that it is believed to use less corrugated material, for a given display stand size, and has less components, thus creating a package that is smaller when collapsed than prior art collapsible display stands. In addition, it is believed to be simpler to erect and collapse in the field, than prior art collapsible display stands.

The foregoing description and drawings merely explain and illustrate the invention, and the invention is not limited except insofar as the appended claims are so limited, as those skilled in the art who have the disclosure before them will be able to make modifications and variations therein without departing from the scope of the invention.

We claim:

1. A collapsible shelving display fabricated at least in part from at least one of paper, paperboard, or corrugated paperboard material, the collapsible shelving display comprising;

a stand, including a substantially planar back wall, having two opposed side edge regions, two side wall assemblies foldably connected to respective ones of the two opposed side edge regions of the back wall, each of the two side wall assemblies being movable between a position substantially perpendicular to the back wall and foldably attached thereto, and a position substantially parallel and juxtaposed to the back wall; and at least one foldable shelf support member, having a first end and a second end, the first end being operably connected to an inner surface of one of the two side wall assemblies, and the second end being operably connected to an inner surface of the other of the two side wall assemblies, the at least one foldable shelf support member being articulable, between a position extending substantially straight across from one side wall assembly to the other and spaced from the back wall when both side wall assemblies are substantially perpendicular to the back wall, and a collapsed position wherein portions of the at least one shelf support member are folded over upon other portions of the shelf support member and substantially juxtaposed against the back wall, when both side wall assemblies are substantially parallel and juxtaposed to the back wall, wherein the at least one foldable shelf support member is an integrally formed component of the stand; and at least one shelf positionable over said shelf support member, for supporting an article, wherein said at least one shelf is a separate member.

2. A collapsible shelving display fabricated at least in part from at least one of paper, paperboard, or corrugated paperboard material, the collapsible shelving display comprising;

a stand, including a substantially planar back wall, having two opposed side edge regions, two side wall assemblies foldably connected to respective ones of the two opposed side edge regions of the back wall, each of the two side wall assemblies being movable between a position substantially perpendicular to the back wall and foldably attached thereto, and a position substantially parallel and juxtaposed to the back wall; and at least one foldable shelf support member operably connected to each of the inner surfaces of the two side wall assemblies, the at least one foldable shelf support member being articulable, between a position extending substantially straight across from one side wall assembly to the other and spaced from the back wall when both side wall assemblies are substantially perpendicular to the back wall, and a collapsed position wherein portions of the at least one shelf support member are folded over upon other portions of the shelf support member and substantially juxtaposed against the back wall, when both side wall assemblies are substantially parallel and juxtaposed to the back wall; and at least one shelf positionable over said shelf support member, for supporting an article;

wherein each side wall assembly comprises:

an inner side panel foldably connected to one of the side edge regions of the back wall;

an outer side panel connected to the inner side panel; and a side reinforcement panel, connected to the outer side panel and disposed between the inner and outer side panels.

3. The collapsible shelving display according to claim 2, in which said at least one shelf comprises at least one shelf member pivotably attached to the back wall, and pivotable between a collapsed position substantially parallel and juxtaposed to the back wall and a supporting position not substantially parallel and juxtaposed to the back wall, such that a portion of the at least one shelf member rests atop a portion of the at least one foldable shelf support member, when the at least one foldable shelf support member is in the position extending substantially straight across from one side wall assembly to the other.

4. The collapsible shelving display according to claim 2, wherein a leading edge of each side wall assembly is inclined.

5. The collapsible shelving display according to claim 2, wherein the at least one foldable shelf support member comprises:

a central panel, having two opposite ends;

end panels foldably connected to each end of the central panel, each end panel further being foldably connected to a respective one of the side wall assemblies, wherein at least the central panel is formed and cut from a portion of the substantially planar back wall.

6. The collapsible shelving display according to claim 5, wherein the at least one foldable shelf support member further comprises:

two support panels, formed and cut from portions of rearward portions of the inside surfaces of the respective side wall assemblies, and folded forward to overlie and be affixed to other adjacent portions of the inside surfaces of the respective side panel assemblies, each of the two support panels being connected to respective ones of the end panels of the at least one foldable shelf support member.

7. The collapsible shelving display according to claim 5, wherein at least the central panel of the at least one shelf support member further comprises a lower portion which is substantially parallel to the back wall, and an upper portion which is foldable between a position substantially parallel to the back wall, and a supporting position at an intersecting angle with respect to the back wall.

8. The collapsible shelving display according to claim 7, wherein the stand is fabricated from corrugated paperboard material, and the corrugations are oriented such that the corrugations extend horizontally in the lower portions of the central panel of the at least one shelf support member.

9. The collapsible shelving display according to claim 5, wherein at least one of the end panels of the at least one shelf support member comprises a lower portion which is substantially parallel to the back wall, and an upper portion which is foldable between a position substantially parallel to the back wall, and a supporting position at an intersecting angle with respect to the back wall.

10. The collapsible shelving display according to claim 8, wherein the stand is fabricated from corrugated paperboard material, and the corrugations are oriented such that the corrugations extend horizontally in the lower portion of the at least one end panel of the at least one shelf support member.

11. The collapsible shelving display according to claim 2, further comprising a signage riser, extending upwardly from the back wall.

12. The collapsible shelving display according to claim 2, wherein the stand is fabricated from a single blank of material.

13. The collapsible shelving display according to claim 2, further comprising a cover panel connected to and emanating from an upper edge region of each outer side panel, for covering a gap between each respective outer side panel and its corresponding inner side panel.

14. A collapsible shelving display fabricated at least in part from corrugated paperboard material, the collapsible shelving display comprising;

a stand, including a substantially planar back wall, having two opposed side edge regions, two side wall assemblies foldably connected to respective ones of the two opposed side edge regions of the back wall, each of the two side wall assemblies being movable between a position substantially perpendicular to the back wall and foldably attached thereto, and a position substantially parallel and juxtaposed to the back wall; and at least one foldable shelf support member, having a first end and a second end, the first end being operably connected to an inner surface of one of the two side wall assemblies, and the second end being operably connected to an inner surface of the other of the two side wall assemblies, the at least one foldable shelf support member being articulable, between a position extending substantially straight across from one side wall assembly to the other and spaced from the back wall when both side wall assemblies are substantially perpendicular to the back wall, and a collapsed position wherein portions of the at least one shelf support member are folded over upon other portions of the shelf support member and substantially juxtaposed against the back wall, when both side wall assemblies are substantially parallel and juxtaposed to the back wall, wherein the at least one foldable shelf support member is an integrally formed component of the stand;

wherein the corrugations of the corrugated paperboard material, in the planar back wall, the two side wall assemblies and the at least one foldable shelf support member, extend horizontally.

* * * * *